US007497885B2

(12) United States Patent
Kollodge

(10) Patent No.: US 7,497,885 B2
(45) Date of Patent: Mar. 3, 2009

(54) ABRASIVE ARTICLES WITH NANOPARTICULATE FILLERS AND METHOD FOR MAKING AND USING THEM

(75) Inventor: Jeffrey S. Kollodge, Stillwater, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 0 days.

(21) Appl. No.: 11/671,037

(22) Filed: Feb. 5, 2007

(65) Prior Publication Data

US 2008/0148651 A1 Jun. 26, 2008

Related U.S. Application Data

(60) Provisional application No. 60/871,720, filed on Dec. 22, 2006.

(51) Int. Cl.

| | |
|---|---|
| ***B24D 3/02*** | (2006.01) |
| ***C09C 1/68*** | (2006.01) |
| ***C09K 3/14*** | (2006.01) |
| ***B24B 1/00*** | (2006.01) |
| ***B25D 11/00*** | (2006.01) |

(52) U.S. Cl. ..... 51/307; 51/295; 51/308; 51/309

(58) Field of Classification Search ..... 51/308, 51/309, 307, 295

See application file for complete search history.

(56) References Cited

U.S. PATENT DOCUMENTS

| | | | | |
|---|---|---|---|---|
| 4,314,827 | A | 2/1982 | Leitheiser et al. | |
| 4,623,364 | A | 11/1986 | Cottringer et al. | |
| 4,744,802 | A | 5/1988 | Schwabel | |
| 4,770,671 | A | 9/1988 | Monroe et al. | |
| 4,881,951 | A | 11/1989 | Monroe et al. | |
| 5,014,468 | A | 5/1991 | Ravipati et al. | |
| 5,152,917 | A | 10/1992 | Pieper et al. | |
| 5,391,210 | A | 2/1995 | Bilkadi et al. | |
| 5,692,950 | A | 12/1997 | Rutherford et al. | |
| 5,942,015 | A | 8/1999 | Culler et al. | |
| 5,958,794 | A | 9/1999 | Bruxvoort et al. | |
| 6,007,407 | A | 12/1999 | Rutherford et al. | |
| 6,194,317 | B1 | 2/2001 | Kaisaki et al. | |
| 6,258,137 | B1 | 7/2001 | Garg et al. | |
| 6,287,353 | B1 * | 9/2001 | Celikkaya | 51/309 |
| 6,551,366 | B1 | 4/2003 | D'Souza et al. | |
| 6,645,624 | B2 | 11/2003 | Adefris et al. | |
| 6,758,727 | B2 * | 7/2004 | Coad | 451/41 |
| 6,802,878 | B1 * | 10/2004 | Monroe | 51/307 |
| 6,945,851 | B2 | 9/2005 | Ward et al. | |
| 7,052,625 | B2 | 5/2006 | Chamberlin et al. | |
| 2006/0207187 | A1 * | 9/2006 | Gaeta et al. | 51/293 |

FOREIGN PATENT DOCUMENTS

| | | |
|---|---|---|
| WO | WO 95/07797 | 3/1995 |
| WO | WO 95/22436 | 8/1995 |

* cited by examiner

*Primary Examiner*—Karl E Group
*Assistant Examiner*—Noah S Wiese
(74) *Attorney, Agent, or Firm*—James A. Baker

(57) ABSTRACT

The disclosure relates to fixed abrasive articles having a plurality of three-dimensional abrasive composites including abrasive particles dispersed in a matrix material including a polymeric binder and a plurality of nanoparticulate inorganic filler particles having a volume mean diameter no greater than 1000 nanometers (nm). In some embodiments, the volume mean diameter of the abrasive particles is less than 500 nm, and the volume mean diameter of the inorganic filler particles is no greater than 200 nm. In other embodiments using non-ceria abrasive particles, the ratio of the amount of matrix material to the amount of non-ceria abrasive particles on a volumetric basis is at least 2. In alternate embodiments using non-ceria abrasive particles, the ratio of the amount of non-ceria abrasive particles to the amount of inorganic filler particles on a volumetric basis is no greater than 3. Also provided are methods of making and using fixed abrasive articles according to the disclosure.

27 Claims, No Drawings

ABRASIVE ARTICLES WITH NANOPARTICULATE FILLERS AND METHOD FOR MAKING AND USING THEM

CROSS REFERENCE TO RELATED APPLICATIONS

This application claims the benefit of U.S. Provisional Patent Application No. 60/871,720, filed Dec. 22, 2006, the disclosure of which is incorporated by reference herein in its entirety.

TECHNICAL FIELD

This disclosure relates to fixed abrasive articles including nanoparticulate fillers and methods for making and using these articles. The disclosure further relates to fixed abrasive articles useful in chemical mechanical planarization (CMP) processing of wafers,

BACKGROUND

Abrasive articles are frequently used for microfinishing applications such as semiconductor wafer polishing, microelectromechanical (MEMs) device fabrication, finishing of substrates for hard disk drives, polishing of optical fibers and connectors, and the like. For example, during integrated circuit manufacture, semiconductor wafers typically undergo numerous processing steps including deposition of metal and dielectric layers, patterning of the layers, and etching. In each processing step, it may be necessary or desirable to modify or refine an exposed surface of the wafer to prepare it for subsequent fabrication or manufacturing steps. The surface modification process may be used generally to modify deposited conductors, e.g. metals, semiconductors, and/or dielectric materials. The surface modification process may also be used to create a planar outer exposed surface on a wafer having an exposed area of a conductive material, a dielectric material, or a combination.

One recent method of modifying or refining exposed surfaces of structured wafers treats a wafer surface with a fixed abrasive article. In use, the fixed abrasive article may be contacted with a semiconductor wafer surface, often in the presence of a working liquid, with a motion adapted to modify a layer of material on the wafer and provide a planar, uniform wafer surface. The working liquid may be applied to the surface of the wafer to chemically modify or otherwise facilitate the removal of material from the surface of the wafer under the action of the abrasive article.

SUMMARY

In general, the present disclosure relates to fixed abrasive articles for polishing a workpiece such as a wafer in a chemical mechanical planarization (CMP) process. The present inventor discovered a need for improved fixed abrasive articles exhibiting longer life and other performance enhancements when used in a CMP process. For the purpose of describing the present invention, the non-limiting example of abrasive articles suitable for processing workpieces in the form of semiconductor wafers useful in the fabrication of electronic devices will be described. It will be appreciated by one skilled in the art that other workpieces may be employed For example, MEMS devices, substrates for use in hard disk drives, and the like may be abraded by articles of the present invention. In some embodiments, the abrasive articles and methods of the present invention are particularly well suited for microfinishing applications.

In one aspect, the disclosure provides a fixed abrasive article including a plurality of three-dimensional abrasive composites. The abrasive composites include a plurality of abrasive particles having a volume mean diameter less than 500 nanometers dispersed in a matrix material. The matrix material further comprises a polymeric binder and a plurality of dispersed inorganic filler particles having a volume mean diameter no greater than 200 nanometers.

In another aspect, the disclosure provides a fixed abrasive article including a plurality of three-dimensional abrasive composites fixed to the abrasive article, wherein the plurality of abrasive composites include a plurality of non-ceria abrasive particles dispersed in a matrix material, wherein the matrix material further comprises a polymeric binder and inorganic filler particles having a volume mean diameter no greater than 1,000 nm, and wherein a ratio of the amount of matrix material to the amount of non-ceria abrasive particles on a volumetric basis is at least 2. In certain embodiments, the ratio of the amount of non-ceria abrasive particles to the amount of inorganic filler particles on a volumetric basis is at most 3:1, and a ratio of the amount of polymeric binder to the amount of non-ceria abrasive particles on a volumetric basis is at least 2:1.

In an additional aspect, the disclosure provides a fixed abrasive article including a plurality of three-dimensional abrasive composites fixed to the abrasive article, wherein the plurality of abrasive composites include a plurality of non-ceria abrasive particles dispersed in a matrix material, wherein the matrix material further comprises a polymeric binder and inorganic filler particles having a volume mean diameter no greater than 1,000 nm, and wherein a ratio of the amount of non-ceria abrasive particles to the amount of inorganic filler on a volumetric basis is no greater than 3. In certain embodiments, the ratio of the amount of matrix material to the amount of non-ceria abrasive particles on a volumetric basis is at least 2:1, and the ratio of the amount of polymeric binder to the amount of non-ceria abrasive particles on a volumetric basis is at least 2:1.

In a further aspect, the disclosure provides methods of making fixed abrasive articles, such as the fixed abrasive articles described above. In one exemplary embodiment of a method of making a fixed abrasive article, a plurality of three-dimensional abrasive composites is formed, and the abrasive composites include a plurality of abrasive particles having a volume mean diameter less than 500 nanometers dispersed in a matrix material. The matrix material includes a polymeric binder and a plurality of dispersed inorganic filler particles having a volume mean diameter no greater than 200 nanometers.

In another exemplary embodiment of a method of making a fixed abrasive article, a plurality of three-dimensional abrasive composites is formed, and the plurality of abrasive composites includes a plurality of non-ceria abrasive particles dispersed in a matrix material. The matrix material further comprises a polymeric binder and a plurality of dispersed inorganic filler particles having a volume mean diameter no greater than 1,000 nm. In some embodiments, the ratio of the amount of matrix material to the amount of non-ceria abrasive particles on a volumetric basis is at least 2. In other embodiments, the ratio of the amount of non-ceria abrasive particles to the amount of inorganic filler on a volumetric basis is no greater than 3.

In an additional aspect, the disclosure provides methods of using fixed abrasive articles made according to the above described methods. In some embodiments, the disclosure provides methods for using fixed abrasive articles in CMP. In various embodiments, the method includes providing a wafer, contacting the wafer with a fixed abrasive article comprising a plurality of three-dimensional abrasive composites, and relatively moving the wafer and the fixed abrasive article, optionally in the presence of a liquid medium. In one exemplary embodiment, the plurality of abrasive composites include a plurality of abrasive particles having a volume mean diameter less than 500 nanometers dispersed in a matrix material. The matrix material further comprises a polymeric binder and a plurality of dispersed inorganic filler particles having a volume mean diameter no greater than 200 nanometers.

In another exemplary embodiment, the plurality of abrasive composites includes a plurality of non-ceria abrasive particles dispersed in a matrix material. The matrix material further comprises a polymeric binder and inorganic filler particles having a volume mean diameter no greater than 1,000 nm, and the ratio of the amount of matrix material to the amount of non-ceria abrasive particles on a volumetric basis is at least 2. In an alternative exemplary embodiment, the ratio of the amount of non-ceria abrasive particles to the amount of inorganic filler on a volumetric basis is no greater than 3.

It may be an advantage of one or more embodiments of the present disclosure to make improved fixed abrasive articles for use in CMP processes. In some exemplary embodiments, the fixed abrasive articles may be useful in abrading a dielectric material. In other exemplary embodiments, the fixed abrasive articles may be useful in polishing metal layers, for example copper, aluminum or tungsten layers, deposited on a wafer. In certain exemplary embodiments, such fixed abrasive articles may be long lasting, e.g., the abrasive article may be able to process at least 5-20, and even 30 or more wafers. The abrasive articles, in some embodiments, may also provide a good dielectric material removal rate. Additionally, the abrasive articles may be capable, of yielding, in certain embodiments, a semiconductor wafer having an acceptable flatness, surface finish and minimal dishing.

The above summary is not intended to describe each illustrated embodiment or every implementation of the present disclosure. The Detailed Description that follows more particularly exemplifies certain preferred embodiments using the principles disclosed herein.

DETAILED DESCRIPTION

Throughout this disclosure, the following definitions apply:

A "fixed abrasive article" is an integral abrasive article that is substantially free of unattached abrasive particles except as may be released during the abrading process.

A "three-dimensional abrasive article" is an abrasive article having numerous abrasive particles extending throughout at least a portion of its thickness such that removing some of the particles during the abrading process exposes additional abrasive particles capable of performing the abrading function.

A "textured abrasive article" is an abrasive article having raised portions and recessed portions in which at least the raised portions contain abrasive particles and polymeric binder.

An "erodible abrasive article" is an abrasive article that breaks down under use conditions in a controlled manner.

An "abrasive composite" refers to one of a plurality of shaped bodies which collectively provide a textured, three-dimensional abrasive article comprising abrasive particles and a polymeric binder.

A "precisely shaped abrasive composite" refers to an abrasive composite having a molded shape that is substantially the inverse of the mold cavity which may be retained after the composite has been removed from the mold. In certain embodiments, the composite may be substantially free of abrasive particles protruding beyond the exposed surface of the shape before the abrasive article has been used, for example, as described in U.S. Pat. No. 5,152,917 (Pieper et al.), the entire disclosure of which is incorporated herein by reference.

A "matrix material" refers to the material in which the abrasive particles are dispersed. As used herein, the matrix material comprises the polymeric binder and the plurality of nanoparticulate inorganic filler particles dispersed within the polymeric binder.

A "sol" refers to a collection of non-aggregated colloidal particles dispersed in a liquid medium.

A "colloidal metal oxide particle" refers to a metal oxide particle, preferably spherical in shape, having a volume mean diameter no greater than 1,000 nanometers.

A "ceramer" refers to a composition comprising substantially non-aggregated colloidal metal oxide particles dispersed in a polymeric binder precursor.

Fixed abrasive articles for use in finishing operations during the manufacture of semiconductor devices have been described in the art. They offer benefits with respect to the results obtained, such as planarity, and with respect to the disposal of process materials such as spent abrasive slurry. In addition, they generally are used in processes that result in less debris remaining on the wafer surface. Such debris can require extensive cleaning operations and may lead to lower device yields, especially as feature sizes are reduced.

With respect to the above discussion of fixed abrasive articles for CMP, applicant has discovered that the abrasive performance of fixed abrasive articles described in the art can be substantially maintained while enhancing the overall article life by replacing a portion of the abrasive particles with an equivalent volume of nanoparticulate inorganic filler particles. This replacement is contrary to the teachings of the art, which teaches optimization of the ratio of abrasive particles to polymeric binder in order having the desired abrasion rate, and then optionally introduces plasticizers, micro-particulate fillers (i.e., fillers having a volume mean particle diameter greater than one micrometer or 1,000 nanometers) and other agents to modify the erodibility of the abrasive composites.

The art teaches that a significant degree of erodibility of the abrasive article is necessary to replace worn abrasive particles at the surface of the abrasive article in order to prevent a reduction in the wafer dielectric material removal rate as the exposed abrasive particles dulled. It was further taught that increasing the degree of erodibility produces a corresponding decrease in the useful life of the abrasive article. Thus, efforts to increase the durability of a fixed abrasive article resulted in a corresponding reduction in the material removal rate as the abrasive particles are dulled. Alternatively, efforts to increase the material removal rates of a fixed abrasive article inevitably resulted in an undesirable reduction of the article's useful life.

While not wishing to be bound by any particular theory, applicant has found that replacing abrasive particles with nanoparticulate inorganic filler particles dispersed within a matrix material forming the abrasive composites of the fixed abrasive article acts to substantially maintain the material removal rate of the abrasive composite, while increasing the durability and life of the fixed abrasive article. Thus replacement of a portion of the abrasive particles by nanoparticulate inorganic fillers may result, in certain embodiments, in unexpected increases in the overall life of the abrasive article while maintaining a higher than expected material removal rate similar to and in some cases greater than for an abrasive article containing the abrasive particles alone, at a comparable volume fraction.

The embodiments may take on various modifications and alterations without departing from the spirit and scope of the disclosure. Accordingly, it is understood that the disclosure is not limited to the following described embodiments, but is controlled by the limitations set forth in the claims and any equivalents thereof. In particular, all numerical values and ranges recited herein are intended to be modified by the term "about," unless stated otherwise. The recitation of numerical ranges by endpoints includes all numbers subsumed within that range (e.g., 1 to 5 includes 1, 1.5, 2, 2.75, 3, 3.80, 4, and 5). Various embodiments of the disclosure will now be described.

Fixed Abrasive Articles

In some exemplary embodiments according to the present disclosure, fixed abrasive articles comprising a plurality of three-dimensional abrasive composites are made. In one exemplary method of making a fixed abrasive article, a plurality of three-dimensional abrasive composites is formed. The abrasive composites include a plurality of abrasive particles having a volume mean diameter less than 500 nanometers dispersed in a matrix material. The matrix material further includes a polymeric binder and a plurality of dispersed inorganic filler particles having a volume mean diameter no greater than about 200 nanometers.

In another exemplary method, a plurality of three-dimensional abrasive composites is formed, and the plurality of abrasive composites includes a plurality of non-ceria abrasive particles dispersed in a matrix material. The matrix material further includes a polymeric binder and inorganic filler particles having a volume mean diameter no greater than 1,000 nm, and the ratio of the amount of matrix material to the amount of non-ceria abrasive particles on a volumetric basis is at least 2.

In an alternative exemplary method, a plurality of three-dimensional abrasive composites is formed, and the plurality of abrasive composites includes a plurality of non-ceria abrasive particles dispersed in a matrix material. The matrix material further comprises a polymeric binder and inorganic filler particles having a volume mean diameter no greater than 1,000 μm, and the amount of non-ceria abrasive particles to the amount of inorganic filler on a volumetric basis is no greater than 3.

In some embodiments of fixed abrasive articles described herein, the abrasive composites are "three-dimensional" such that there are numerous abrasive particles throughout at least a portion of the thickness of the abrasive article. The abrasive article may also have a "texture" associated with it, i.e., it may be a "textured" abrasive article. This can be seen with reference to the abrasive articles illustrated in FIG. 3 of Culler, et al. (U.S. Pat. No. 5,942,015), the disclosures of which is incorporated herein by reference, in which the pyramid-shaped composites are the raised portions and in which the valleys between the pyramids are the recessed portions.

The recessed portions may act as channels to help distribute the working liquid over the entire wafer surface. The recessed portions may also act as channels to help remove the worn abrasive particles and other debris from the wafer and abrasive article interface to minimize undesirable scratching. The recessed portions may also minimize the phenomenon known in the art as "stiction". If the abrasive surface is too smooth rather than textured, an abrasive article may tend to stick to or become lodged against the wafer surface. Finally, the recessed portions may allow a higher unit pressure and shear on the raised portions of the abrasive article and, thus help to expel dulled abrasive particles from the abrasive surface and expose new abrasive particles.

Additionally, in certain embodiments, the abrasive articles may be in the form of an abrasive layer secured to a subpad. The abrasive layer may be formed by coating, extrusion, or other methods known to those skilled in the art. The subpad may have a front surface and a back surface and the abrasive layer may be present over the front surface and/or the back surface of the subpad. The abrasive layer may be applied to a front surface of a backing. An adhesive, for example a pressure sensitive adhesive, may be applied to the opposing surface of the backing. The back surface of the backing may be attached to the subpad with the adhesive in order to fix the abrasive article to the subpad. Suitable subpads are described, for example, in U.S. Pat. Nos. 5,692,950 and 6,007,407, the entire disclosure of each reference is incorporated herein by reference.

In some embodiments, the abrasive articles of the present disclosure may be generally circular in shape, e.g., in the form of an abrasive disc. The outer edges of the circular abrasive disc are preferably smooth, or may be scalloped. The abrasive articles may also be in the form of an oval or of any polygonal shape such as triangular, square, rectangular, and the like. Alternatively, the abrasive articles may be in the form of a belt in another embodiment. The abrasive articles may be provided in the form of a roll, typically referred to in the abrasive art as abrasive tape rolls. In general, the abrasive tape rolls may be indexed or moved continuously during the CMP process. The abrasive article may be perforated to provide openings through the abrasive coating and/or the backing to permit the passage of the liquid medium before, during and/or after use.

In certain exemplary embodiments, the abrasive article may be long lasting, e.g., the abrasive article may be able to process at least two, preferably at least 5, more preferably at least 20, and most preferably at least 30 wafers. In some exemplary embodiments, the fixed abrasive articles may be useful in abrading and/or polishing metal layers, for example copper, aluminum or tungsten layers, deposited on a wafer. The abrasive article may, in some embodiments, provide a good dielectric material removal rate. Additionally, the abrasive article may be capable, in certain embodiments, of yielding a semiconductor wafer having an acceptable flatness, surface finish and minimal dishing. In some embodiments, the wafer's material composition, structure and feature sizes may influence the selection of the composition and structure of the abrasive article, The materials, desired texture, and/or process used to make the abrasive article may influence whether or not these criteria are met.

In other exemplary embodiments, the fixed abrasive article may be a three-dimensional fixed abrasive article comprising a backing (as described below) having a first major surface and a second major surface, and a plurality of abrasive composites distributed on the first major surface of the backing.

Abrasive Particles

The abrasive composites according to the present disclosure comprise abrasive particles dispersed in a matrix material comprising a polymeric binder and nanoparticulates fillers. The abrasive particles may be homogeneously or heterogeneously dispersed in the polymeric binder. The term "dispersed" refers to the abrasive particles and/or nanoparticulate filler particles being distributed throughout the polymeric binder. It may be generally preferred that the abrasive particles and/or nanoparticulate filler particles be homogeneously dispersed so that the resulting abrasive coating provides a more consistent abrading process.

The abrasive particles can be any suitable abrasive particles that provide the desired properties on the exposed wafer surface and specific abrasive particles may be used for specific types of materials. Desired properties may include material removal rate, surface finish, and planarity of the exposed wafer surface. The abrasive particles may be selected depending upon the specific material of the wafer surface. For example, for copper wafer surfaces the preferred abrasive particles include alpha alumina particles. Alternatively for aluminum wafer surfaces, the preferred abrasive particles include alpha and chi alumina. In certain exemplary embodiments, the abrasive particles comprise alumina, ceria, silica, zirconia, boron carbide, silicon nitride, cubic boron nitride, diamonds, or a combination thereof.

In other exemplary embodiments, the abrasive particles are specifically selected to reduce their chemical activity in the material removal process. For example, in certain embodiments in which ceria abrasive particle are used for polishing conductive materials, the chemical activity of the ceria may adversely affect the overall polishing performance. Therefore, in some exemplary embodiments, the abrasive particles are selected to be particles other than cerium oxide (i.e. ceria). In certain of these exemplary embodiments, the abrasive particles are selected to be alumina abrasive particles. Examples of suitable alumina abrasive particles include fused alumina (i.e. aluminum oxide), heat treated aluminum oxide, white fused aluminum oxide, porous alumina, transition metal impregnated alumina, fused alumina-zirconia, or alumina-based sol gel derived abrasive particles. Alumina abrasive particle may also contain a metal oxide modifier. Examples of useful alumina-based sol gel derived abrasive particles can be found in U.S. Pat. Nos. 4,314,827; 4,623,364; 4,744,802; 4,770,671; and 4,881,951, the disclosures of which are incorporated herein by reference.

In some embodiments, the abrasive particles may be provided as abrasive agglomerates. Examples of abrasive agglomerates may be found in U.S. Pat. Nos. 6,551,366 and 6,645,624, the entire disclosures of each being incorporated herein by reference.

The size of the abrasive particles may be selected, in part, based upon the particular composition of the workpiece, e.g. the wafer compositon and structure, and selection of the optional working liquid used during the abrading process. In almost all cases there will be a range or distribution of abrasive particle sizes. In some instances it may be preferred that the particle size distribution be tightly controlled such that the resulting abrasive article provides a very consistent surface finish on the wafer. For purposes of this disclosure, the abrasive particle size is referenced to a volume mean particle diameter, determined using laser light scattering, for example.

The average particle size (i.e. volume mean particle diameter) of the abrasive particles may generally range from about 0.001 to about 40 micrometers, but is more typically between 0.01 to 10 micrometers. For modifying or refining wafer surfaces, fine abrasive particles are preferred. In general, abrasive particles having a volume mean particle diameter no greater than about 5 micrometers (5,000 nanometers, m) are particularly useful in practicing the present disclosure. In some embodiments, preferred abrasive particles exhibit a volume mean particle size no greater than 1.0 micrometer (1,000 nm). In certain exemplary embodiments, the abrasive particles are selected to exhibit a volume mean particle diameter no greater than 0.5 micrometer (500 μm). In some instances, the volume mean particle diameter of the abrasive particles may be selected to be 0.35 micrometer or less.

Nanoparticulate Inorganic Fillers

The fixed abrasive articles further comprise inorganic filler particles. For purposes of this disclosure, the inorganic filler particles may comprise non-organic particulate material which does not abrade the wafer surface to any significant extent, relative to abrasion produced by the abrasive particles. Thus, whether a particulate material is an inorganic filler particle will depend upon the chemical composition of the material, the composition and size of the abrasive particles comprising the abrasive article, the composition of the substrate being abraded, e.g. the composition of the wafer, and the composition of the optional working liquid. It is possible for a material to act as an inorganic filler particle in the context of one wafer surface and as an abrasive particle in the context of a different wafer surface. Useful inorganic filler particles include inorganic oxide filler particles, for example, inorganic oxide filler particles comprising silicon oxide, aluminum oxide, titanium oxide, zirconium oxide, glass, or a combination thereof. The inorganic filler particles can be in the form of a powder, gel or sol.

Particularly useful inorganic filler particles of the present invention may be nanoparticulate inorganic fillers, which are defined herein as inorganic particles having a volume mean diameter no greater than 1 micrometer (i.e. 1,000 nanometers). Thus, the preferred volume mean diameter of the nanoparticulate filler particles may be selected, in some embodiments, to be no greater than about 1,000 nm, more preferably no greater than about 500 nm, and still more preferably no greater than about 100 nm. In certain presently preferred embodiments, the filler particles exhibit a volume mean diameter less than about 50 nm, most preferably less than about 25 nm. Preferred nanoparticlulate inorganic fillers for the practice of the present disclosure include silica (i.e. silicon oxide), zirconia (i.e. zirconium oxide), and alumina (i.e. aluminum oxide). Nanoparticlulate inorganic fillers in the form of colloidal metal oxide particles may be preferred.

Colloidal metal oxide particles particularly suitable for use in the invention are non-aggregated metal oxide particles dispersed as sols and having an average particle diameter of from about 5 to no greater than 1,000 nanometers, preferably from about 10 to about 100 nanometers, and more preferably from about 10 to about 50 nanometers. These size ranges are preferred on the basis of both ease of dispersing the metal oxide particles in the polymeric binder and on the improvement in the life of the abrasive articles.

The colloidal metal oxide particles may be formed of any metal oxide, in any oxidation state. Examples of preferred metal oxides include silica, alumina, zirconia, vanadia, titania, with silica being most preferred.

Dispersing of the nanoparticulate inorganic fillers in the polymeric binder may be important to increasing the useful life of the abrasive articles of the present invention. A prefered method of incorporating the nanoparticulate inorganic fillers in the polymeric binder is to combine the polymeric binder with a sol. More preferred is to combine a polymeric binder precursor with a sol. After removal of a substantial portion of the liquid medium of the sol from the polymeric binder precursor-sol mixture, it is preferred that a ceramer is formed, i.e., that the colloidal metal oxide particles comprising the nanoparticulate inorganic filler are substantially non-aggregated. The ceramer may be preferably substantially free of the liquid medium of the sol. More preferably, the ceramer contains less than 5% by weight of the liquid medium of the sol, most preferably less than 1% by weight of the liquid medium of the sol.

Representative examples of liquid media suitable as dispersants for the colloidal metal oxide particles include water, aqueous alcohol solutions, lower aliphatic alcohols, toluene, ethylene glycol, dimethyl acetamide, formamide, and combinations thereof. The preferred liquid medium is water. When the colloidal metal oxide particles are dispersed in water, the particles are stabilized on account of common electrical charges on the surface of each particle, which tends to promote dispersion rather than agglomeration. The like charged particles repel one another, thereby preventing aggregation.

Sols useful for preparing ceramers can be prepared by methods well known in the art. Colloidal silicas dispersed as sols in aqueous solutions are also available commercially under such trade names as "LUDOX" (E.I. dupont de Nemours and Co., Inc. Wilmington, Del.), "NYACOL" (Nyacol Co., Ashland, Mass.), and "NALCO" (Nalco Chemical Co., Oak Brook, Ill.). Non-aqueous silica sols (also called silica organosols) are also commercially available under such trade names as "NALCO 1057" (a silica sol in 2-propoxyethanol, Nalco Chemical Co., Oak Brook, Ill.), and "MA-ST", "IP-ST", and "EG-ST", (Nissan Chemical Industries, Tokyo, Japan). Sols of other oxides are also commercially available, e.g., "NALCO ISJ-614" and "NALCO ISJ-613" alumina sols, and "NYACOL 10/50" zirconia sol.

In further embodiments, the inorganic fillers may be provided with a surface treatment comprising one or more surface treatment agents. Examples of suitable surface treatment agents include silanes, titanates, zirconates, organophosphates, and organosulfonates. When nanoparticlulate inorganic fillers are employed, preferred surface treatment agents comprise silane compounds. Surface treatment agents may be mixed with the metal oxide sol to enhance the dispersibility of the metal oxide particles in the polymeric binder or polymeric binder precursor. The preferred surface treatment agents are hydrolyzable silane compounds. Examples of silane surface treatment agents suitable for this invention include octyltriethoxysilane, vinyltrimethoxysilane, vinyl triethoxysilane, methyltrimethoxysilane, methyltriethoxysilane, propyltrimethoxysilane, propyltriethoxysilane, tris-[3-(trimethoxysilyl)propyl] isocyanurate, vinyl-tris-(2-methoxyethoxy)silane, gamm-methacryloxypropyltrimethoxysilane, beta-(3, 4-epoxycyclohexyl)ethyltrimethoxysilane, gamma-glycidoxypropyltrimethoxysilane gamma-mercaptopropyltrimethoxysilane, gamma-aminopropyltriethoxysilane, gamma-aminopropyltrimethoxysilane, N-beta-(aminoethyl)-gamma-aminopropyltrimethoxysilane, bis-(gamma-trimethoxysilylpropyl)amine, N-phenyl-gamma-aminopropyltrimethoxysilane, gamma-ureidopropyltrialkoxysilane, gamma-ureidopropyltrimethoxysilane, acryloxyalkyl trimethoxysilane, methacryloxyalkyl trimethoxysilane, phenyl trichlorosilane, phenyltrimethoxysilane, phenyl triethoxysilane, A1230 proprietary non-ionic silane dispersing agent (available from OSI Specialties, Inc., Danbury, Conn.) and mixtures thereof. Examples of commercially available surface treatment agents include "A174" and "A1230" (available from OSI Specialties, Inc., Danbury, Conn.).

The dispersability of the nanoparticulate inorganic fillers in a particular polymeric binder or polymeric binder precursor may depend upon the selection of the surface treatment agent. Often, it may be preferred to have a mixture of two or more surface treatment agents producing the desirable degree of dispersion. A dispersion of nanoparticulate inorganic fillers that are substantially non-aggregated in a polymeric binder or polymeric binder precursor may be preferred.

In further embodiments, the nanoparticulate inorganic fillers may have a surface treatment formed by a surface treatment agent that provides an association bridge between one or more of the polymeric binder and/or polymeric binder precursor, and the surface of the nanoparticulate inorganic filler particles. When desirable, the chemical composition of the polymeric binder or polymeric binder precursor and the surface of the nanoparticulate inorganic filler particles may be selected in conjunction with the chemical composition of the surface treatment agent(s) to facilitate this bridge. In some embodiments, bridging may be achieved through inherent attractive forces (for example, Van der Waals forces) between the polymeric binder or polymeric binder precursor and the surface treatment agent; and inherent attractive forces between the surface treatment agent and the surface of the nanoparticulate filler particle. In further embodiments, bridging may be achieved by chemical reaction between functional groups comprising one or more of the polymeric binder, the polymeric binder precursor, the surface treatment agent, and the surface of the nanoparticulate filler particle, acid-base interactions and ionic interactions being included.

The nanoparticulate inorganic filler may alter the erodibility of the abrasive article. In some instances with the appropriate nanoparticulate inorganic filler and amount, the nanoparticulate inorganic filler may decrease the erodibility of the abrasive article. Nanoparticulate inorganic fillers may also be selected to reduce the cost of the abrasive article, alter the rheology of the polymric binder or polymeric binder precursor, and/or to alter the abrading characteristics of the abrasive article.

Matrix Material and Binders

In the fixed abrasive articles according to the present disclosure, the abrasive composites are formed by a matrix material that may fix the abrasive particles in the abrasive article so that the abrasive particles do not readily disassociate from the abrasive article during the abrading process. In certain embodiments, the matrix material includes a polymeric binder and a plurality of nanoparticulate filler particles dispersed within the polymeric binder. The polymeric binder may, for example, comprise a polymer or polymeric binder precursor. In certain embodiments, the polymeric binder is a pre-formed polymer.

Alternatively, in some embodiments, the polymeric binders for the abrasive articles may be formed in situ from an organic polymeric binder precursor. The polymeric binder precursor preferably may be capable of flowing sufficiently so as to be coatable, and then solidifying. Solidification may be achieved by curing (e.g., polymerizing and/or crosslinking) and/or by drying, or simply upon cooling. The polymeric binder precursor may be an organic solvent-borne, a water-borne, or a 100% solids (i.e., a substantially solvent-free) composition. Thermoplastic or thermosetting polymers or materials, as well as combinations thereof, may be used as the polymeric binder precursor.

The fixed abrasive article may include, in certain embodiments, a plurality of abrasive particles dispersed in a polymeric binder. The particular chemical and mechanical properties of the polymeric binder, in some embodiments, may be important to the performance of the abrasive article. Thus, the polymeric binder may be selected to provide the desired characteristics of the abrasive article.

In certain embodiments, the preferred polymeric binders are free radical curable polymeric binder precursors. These polymeric binder precursors are capable of polymerizing rapidly upon exposures to thermal energy or radiation energy. One preferred subset of free radical curable polymeric binder precursors includes ethylenically unsaturated polymeric binder precursors. Examples of such ethylenically unsaturated polymeric binder precursors include aminoplast monomers or oligomers having pendant alpha, beta unsaturated carbonyl groups, ethylenically unsaturated monomers, e.g. acrylates or ethylenically unsaturated oligomers, acrylated isocyanurate monomers, acrylated urethane oligomers, acrylated epoxy monomers or oligomers, or diluents, acrylate esters, and mixtures thereof. The term acrylate includes both acrylates and methacrylates.

In some instances, the abrasive composite may be formed from a slurry comprising at least one abrasive material, a nanoparticulate inorganic filler, and a polymeric binder or polymeric binder precursor. In some embodiments, the inorganic filler particles and abrasive particles comprise, on a volume basis, no more than about 70% of the abrasive composite, preferably no more than about 50% of the abrasive composite. In some embodiments, the volume fraction of abrasive particles relative to the volume fraction of abrasive particles and filler particles in the abrasive composite is no greater than about 0.90, preferably no greater than 0.75. In some embodiments, the polymeric binder or polymeric binder precursor comprises at least about 30% of the abrasive composite, preferably at least about 50% of the abrasive composite, on a volume basis.

The polymeric binder precursor may be preferably a curable organic material (i.e., a polymer or material capable of polymerizing and/or crosslinking upon exposure to heat and/or other sources of energy, such as e-beam, ultraviolet, visible, etc., or with time upon the addition of a chemical catalyst, moisture, or other agent which cause the polymer to cure or polymerize). Binder precursor examples include epoxy polymers, amino polymers or aminoplast polymers such as alkylated urea-formaldehyde polymers, melamine-formaldehyde polymers, and alkylated benzoguanamine-formaldehyde polymer, acrylate polymers including acrylates and methacrylates such as vinyl acrylates, acrylated epoxies, acrylated urethanes, acrylated polyesters, acrylated polyethers, vinyl ethers, acrylated oils, and acrylated silicones, alkyd polymers such as urethane alkyd polymers, polyester polymers, reacive urethane polymers, phenolic polymers such as resole and novolac polymers, phenolic/latex polymers, epoxy polymers such as bisphenol epoxy polymers, isocyanates, isocyanurates, polysiloxane polymers including alkylalkoxysilane polymers, or reactive vinyl polymers. The polymers may be in the form of monomers, oligomers, polymers, or combinations thereof. Suitable polymeric binders and polymeric binder precursors are described in U.S. Pat. No. 6,194,317 to Kaisaki et al., the entire disclosure of which is incorporated herein by reference.

In addition to thermosetting polymeric binders, thermoplastic polymeric binders may also be used. Examples of suitable thermoplastic polymeric binders include polyamides, polyethylene, polypropylene, polyesters, polyurethanes, polyetherimide, polysulfone, polystyrene, acrylonitrile-butadiene-styrene block copolymer, styrene-butadiene-styrene block copolymers, styrene-isoprene-styrene block copolymers, acetal polymers, polyvinyl chloride and combinations thereof. Water-soluble polymeric binder precursors optionally blended with a thermosetting resin may be used. Examples of water-soluble polymeric binder precursors include polyvinyl alcohol, hide glue, or water-soluble cellulose ethers such as hydroxypropylmethyl cellulose, methyl cellulose or hydroxyethylmethyl cellulose.

The matrix material and polymeric binder may include other additives such as abrasive particle surface modification additives, dispersants, passivating agents, water soluble additives, water sensitive agents, coupling agents, expanding agents, fibers, antistatic agents, reactive diluents, initiators, suspending agents, lubricants, wetting agents, surfactants, dyes, UV stabilizers, complexing agents, chain transfer agents, accelerators, catalysts, or activators. For the purpose of calculating volume ratios, these compounds are considered to be part of the polymeric binder and matrix material volume. The amounts of these additives may be readily selected by one skilled in the art, guided by this disclosure, to provide the desired properties.

Optional Backing

In certain embodiments, the abrasive article may further include a backing. A variety of backing materials are suitable for this purpose, including both flexible backings and backings that are more rigid. The backing may be selected from a group of materials which have been used previously for abrasive articles, for example paper, nonwoven materials, cloth, treated cloth, polymeric film, primed polymeric film, metal foil, treated versions thereof, and combinations thereof. One preferred type of backing may be a polymeric film. Examples of such polymeric films include polyester films, co-polyester films, microvoided polyester films, polyimide films, polyamide films, polyvinyl alcohol films, polypropylene film, polyethylene film, and the like. In a presently preferred embodiment, the backing may be a primed polyester film.

The thickness of the polymeric film backing generally may be from about 20 micrometers, preferably from about 50 micrometers, most preferably from about 60 micrometers; and may range to about 1,000 micrometers, more preferably to about 500 micrometers, and most preferably to about 200 micrometers. At least one surface of the backing may be coated with a matrix material and abrasive particles. In certain embodiments, the backing may be uniform in thickness. If the backing is not sufficiently uniform in thickness, greater variability in wafer polishing uniformity may result in the CMP process.

In general, when the abrasive article includes a backing, abrasive particles may be dispersed in a matrix material including a polymeric binder and nanoparticulate inorganic filler particles to form three-dimensional abrasive composites which are fixed, adhered, or bonded to the backing.

The polymeric binder used to bond the abrasive composites to an optional backing may be the same as or different from the polymeric binder used to form the abrasive composites. In some embodiments, the polymeric binder used to bond or form the abrasive composites may be a thermoplastic polymeric binder or thermosetting polymeric binder. If the polymeric binder is a thermosetting polymeric binder, the polymeric binder may preferably be formed from a polymeric binder precursor. Specifically, suitable polymeric binder precursors are, in an uncured state, flowable. When the abrasive article may be made, the polymeric binder precursor may be exposed to conditions (typically an energy source) to help initiate cure or polymerization of the polymeric binder precursor. During this polymerization or curing step, the polymeric binder precursor may be solidified and converted into a polymeric binder. In this invention, it may be preferred that the polymeric binder precursor comprises a free radical curable polymer. Upon exposure to an energy source, such as radiation energy, the free radical curable polymer may be chain-extended and/or cross-linked to form the polymeric binder. Examples of some preferred free radical curable polymers include acrylate monomers, acrylate oligomers or acrylate monomer and oligomer combinations.

In certain additional embodiments, the fixed abrasive article includes an adhesive suitable for attaching the fixed abrasive article to a polishing machine. Optionally, the adhesive may be a pressure-sensitive adhesive. Preferably, the adhesive is provided on the back surface of the backing, that is, the major side surface opposite the major side surface coated with abrasive particles dispersed in a matrix material to form three-dimensional abrasive composites. In some embodiments, the fixed abrasive article with an optional backing, may be attached to or used in conjunction with a subpad. Preferred subpads include rigid and/or resilient elements. Suitable subpads are described in U.S. Pat. Nos. 5,692,950 and 6,007,407, the entire disclosure of each being incorporated herein by reference/

Abrasive Composite Configuration

The individual abrasive composite shape may have the form of any of a variety of geometric solids. Preferred abrasive composites may be precisely shaped (as defined above) or irregularly shaped, with precisely shaped composites being preferred. Typically, the abrasive composite is formed such that the base of the abrasive composite, for example, that portion of the abrasive composite in contact with a backing, has a larger surface area than that portion of the abrasive composite distal from the base or backing. The shape of the composite may be selected from among a number of geometric solids such as a cubic, cylindrical, prismatic, rectangular pyramidal, truncated pyramidal, conical, hemispherical, truncated conical, cross, or post-like cross sections with a distal end. Composite pyramids may have four sides, five sides or six sides. The abrasive composites may also have a mixture of different shapes. The abrasive composites may be arranged in rows, in concentric circles, in helices, or in lattice fashion, or may be randomly placed.

The sides forming the abrasive composites may be perpendicular relative to the backing, tilted relative to the backing or tapered with diminishing width toward the distal end. If the sides are tapered, it may be easier to remove the abrasive composite from the cavities of a mold or production tool. The tapered angle may range from about 1 degree, preferably from about 2 degrees, more preferably from about 3 degrees, and most preferably from about 5 degrees at the low end; to about 75 degrees, preferably to about 50 degrees, more preferably to about 35 degrees, and most preferably to about 15 degrees on the high end. The smaller angles are preferred because this results in a consistent nominal contact area as the composite wears. Thus, in general, the taper angle may be a compromise between an angle large enough to facilitate removal of the abrasive composite from a mold or production tool and small enough to create a uniform cross sectional area. An abrasive composite with a cross section that may be larger at the distal end than at the backing may also be used, although fabrication may require a method other than simple molding.

The height of each abrasive composite may be preferably the same, but it may be possible to have composites of varying heights in a single abrasive article. The height of the composites with respect to the backing or to the land between the composites generally may be less than about 2,000 micrometers, and more particularly in the range of from about 25 micrometers to about 200 micrometers. The base dimension of an individual abrasive composite may be about 5,000 micrometers or less, preferably about 1,000 micrometers or less, more preferably less than 500 micrometers. The base dimension of an individual abrasive composite is preferably greater than about 50 micrometers, more preferably greater than about 100 micrometers. The base of the abrasive composites may abut one another, or may be separated from one another by some specified distance.

In some embodiments, the physical contact between adjacent abrasive composites involves no more than 33% of the vertical height dimension of each contacting composite. More preferably, the amount of physical contact between the abutting composites may be in the range of about 1% to about 25% of the vertical height of each contacting composite. This definition of abutting also covers an arrangement where adjacent composites share a common abrasive composite land or bridge-like structure which contacts and extends between facing sidewalls of the composites. Preferably, the land structure has a height of no greater than about 33% of the vertical height dimension of each adjacent composite. The abrasive composite land may be formed from the same slurry used to form the abrasive composites. The composites are "adjacent" in the sense that no intervening composite may be located on a direct imaginary line drawn between the centers of the composites. It may be preferred that at least portions of the abrasive composites be separated from one another so as to provide the recessed areas between the raised portions of the composites.

The linear spacing of the abrasive composites may range from about 1 abrasive composite per linear cm to about 200 abrasive composites per linear cm. The linear spacing may be varied such that the concentration of composites may be greater in one location than in another. For example, the concentration may be greatest in the center of the abrasive article. The areal density of the composite may range, in some embodiments, from about 1 to about 40,000 composites/$cm^2$. It may be also feasible to have areas of the backing exposed, i.e. where the abrasive coating does not cover the entire surface area of the backing. This type of arrangement is further described in U.S. Pat. No. 5,014,468 (Ravipati et al.).

The abrasive composites are preferably set out on a backing in a predetermined pattern or set out on a backing at a predetermined location. For example, in the abrasive article made by providing slurry between the backing and a production tool having cavities therein, the predetermined pattern of the composites will correspond to the pattern of the cavities on the production tool. The pattern may be thus reproducible from article to article.

In one embodiment of a predetermined pattern, the abrasive composites are in an array or arrangement, by which may be meant that the composites are in a regular array such as aligned rows and columns, or alternating offset rows and columns. If desired, one row of abrasive composites may be directly aligned in front of a second row of abrasive composites. Preferably, one row of abrasive composites may be offset from a second row of abrasive composites.

In another embodiment, the abrasive composites may be set out in a "random" array or pattern. By this it may be meant that the composites are not in a regular array of rows and columns as described above. For example, the abrasive composites may be set out in a manner as described in WO PCT 95/07797 published Mar. 23, 1995 (Hoopman et al.) and WO PCT 95/22436 published Aug. 24, 1995 (Hoopman et al.). It may be understood, however, that this "random" array may be a predetermined pattern in that the location of the composites on the abrasive article may be predetermined and corresponds to the location of the cavities in the production tool used to make the abrasive article.

The three-dimensional, textured, abrasive article also may have a variable abrasive coating composition. For example, the center of an abrasive disc may contain an abrasive coating that may be different (e.g., softer, harder, or more or less erodible) from the outer region of the abrasive disc. Similarly, the coating composition may vary across an abrasive web. Such variation may be continuous or it may occur in discrete steps.

Methods of Using Fixed Abrasives in CMP

In some embodiments, the present disclosure provides methods for using fixed abrasive articles in CMP. In various embodiments, the method includes providing a wafer, contacting the wafer with a fixed abrasive article comprising a plurality of three-dimensional abrasive composites, and relatively moving the wafer and the fixed abrasive article, optionally in the presence of a liquid medium. In one exemplary embodiment, the plurality of abrasive composites comprise a plurality of abrasive particles having a volume mean diameter less than 500 nanometers dispersed in a matrix material. The matrix material further comprises a polymeric binder and a plurality of dispersed inorganic filler particles having, in certain embodiments, a volume mean diameter no greater than 200 nanometers.

In another exemplary embodiment, the plurality of abrasive composites comprises a plurality of non-ceria abrasive particles dispersed in a matrix material. The matrix material further comprises a polymeric binder and inorganic filler particles having a volume mean diameter no greater than 1,000 nm, and in some embodiments, the ratio of the amount of matrix material to the amount of non-ceria abrasive particles on a volumetric basis is at least 2. In an alternative exemplary embodiment, the ratio of the amount of non-ceria abrasive particles to the amount of inorganic filler on a volumetric basis is no greater than 3.

CMP Process Operating Conditions

In some exemplary embodiments, the fixed abrasive articles of the present disclosure may be useful in abrading and/or polishing metal layers, for example copper, aluminum or tungsten layers, deposited on a wafer. In other exemplary embodiments, the fixed abrasive articles may be useful in abrading and/or polishing a dielectric material deposited on the wafer and/or the wafer itself. Variables that affect the wafer polishing rate and characteristics include, for example, the selection of the appropriate contact pressure between the wafer surface and abrasive article, type of liquid medium, relative speed and relative motion between the wafer surface and the abrasive article, and the flow rate of the liquid medium. These variables are interdependent, and are selected based upon the individual wafer surface being processed.

In general, since there can be numerous process steps for a single semiconductor wafer, the semiconductor fabrication industry expects that the process will provide a relatively high removal rate of material. In some embodiments, the material removal rate may be at least 100 angstroms per minute (Å/min.), preferably at least 500 Å/min., more preferably at least 1,000 Åmin., and most preferably at least 1500 Å/min. In some instances, it may be desirable for the conductive material removal rate to be at least 2,000 Å/min., or in certain embodiments, 3,000 or even 4,000 Å/min. The material removal rate obtained with a particular abrasive article may vary depending upon the machine conditions and the type of wafer surface being processed. However, although it may be generally desirable to have a high conductor or dielectric material removal rate, the conductor or dielectric material removal rate may be selected such that it does not compromise the desired surface finish and/or topography of the wafer surface.

In general, wafer surface finishes that are substantially scratch and defect free are preferred. The surface finish of the wafer may be evaluated by known methods. One preferred method may be to measure the Rt value of the wafer surface which provides a measure of roughness, and may indicate scratches or other surface defects. The wafer surface may be preferably modified to yield an Rt value of no greater than about 4,000 angstroms (Å), more preferably no greater than about 2,000 Å, and even more preferably no greater than about 500 Å. Rt is be typically measured using an interferometer such as a Wyko RST PLUS interferometer (Wyko Corp., Tucson, Ariz.), or a TENCOR profilometer (KLA-TENCOR Corp., San Jose, Calif.). Scratch detection may also be measured by dark field microscopy. Scratch depths may be measured by atomic force microscopy.

Applicant has discovered that fixed abrasive articles according to the present disclosure, when used in methods according to the disclosure, provide a good conductive material removal rate at an exemplified interface pressure. Also, two or more processing conditions within a planarization process may be used. For example, a first processing segment may comprise a higher interface pressure than a second processing segment. Rotation and translational speeds of the wafer and/or the abrasive article also may be varied during the abrading process. In some embodiments, the abrasive article may be used in a multi-step abrading process. For example, in some exemplary multi-step abrading processes, the fixed abrasive may be used in the first step, in one or more subsequent steps, or in all steps. In other exemplary embodiments, one or more of the steps may include an abrasive slurry used either with or in the absence of the fixed abrasive article.

Wafer surface processing may be conducted in the presence of a working liquid, which may be selected based upon the composition of the wafer surface. In some applications, the working liquid typically comprises water. The working liquid may aid processing in combination with the abrasive article through a chemical mechanical polishing process. During the chemical portion of polishing, the working liquid may react with the outer or exposed wafer surface. Then during the mechanical portion of processing, the abrasive article may remove this reaction product. During the processing of metal surfaces, it may be preferred that the working liquid may be an aqueous solution which includes a chemical etchant such as an oxidizing material or agent.

For example, chemical polishing of copper may occur when an oxidizing agent in the working liquid reacts with the copper to form a surface layer of copper oxides. The mechanical process occurs when the abrasive article removes this metal oxide from the wafer surface. Alternatively, the metal may first be removed mechanically and then react with ingredients in the working fluid. Suitable working liquids are described in Kaisaki et al. (U.S. Pat. No. 6,194,317).

Other useful chemical etchants include complexing agents. These complexing agents may function in a manner similar to the oxidizing agents previously described in that the chemical interaction between the complexing agent and the wafer surface creates a layer which may be more readily removed by the mechanical action of the abrasive composites.

One suitable working liquid comprises a chelating agent, an oxidizing agent, an ionic buffer, and a passivating agent in aqueous solution. One such exemplary working liquid may comprise, for example, $(NH_4)_2HPO_4$, hydrogen peroxide, ammonium citrate, 1-H-benzotriazole, and water. Typically, the solution may be used for polishing copper wafers. Another suitable working liquid comprises an oxidizing agent, an acid, and a passivating agent in aqueous solution. One such exemplary working solution may comprise, for example, hydrogen peroxide, phosphoric acid, 1-H-benzotriazole, and water.

The amount of the working liquid may be preferably sufficient to aid in the removal of metal or metal oxide deposits from the surface. In many instances, there may be sufficient liquid from the basic working liquid and/or the chemical etchant. However, in some instances it may be preferred to have a second liquid present at the planarization interface in addition to the first working liquid. This second liquid may be the same as the first liquid, or it may be different.

EXAMPLES

The following exemplary, but non-limiting, Examples will serve to illustrate embodiments of the invention.

Method 1: Alumina Abrasive Slurry Preparation

The alumina abrasive slurry was prepared by combining the following ingredients: 45.0 g SR 339 2-phenoxyethyl acrylate (Sartomer Company, Inc., Exton, Pa.), 30.0 g SR 9003 propoxylated neopentyl glycol diacrylate (Sartomer Company, Inc., Exton, Pa.), 2.16 g Sipomer™ beta-CEA carboxy ethyl acrylate (Rhodia Inc., Cranbury, N.J.), 5.00 g Disperbyk™ 111 phosphated polyester steric group (BYK Chemie, Wallingford, Conn.), 216.4 g Tizox™ 8109 alumina (Ferro Electronic Materials, Penn Yan, N.Y.), 0.80 g Irgacure™ 819 bis(2,4,6-trimethylbenzoyl phenylphosphineoxide (Ciba Specialty Chemicals, Tarrytown, N.Y.), to form an abrasive slurry. The acrylates were mixed 5 minutes prior to addition of Sipomer™ beta-CEA and Disperbyk™ 111. Mixing continued for 5 minutes after addition of the later two ingredients. After alumina addition, the slurry was mixed with a high shear mixer for 1 hour then Irgacure™ 819 was added to the composition which was further mixed 30 minutes.

Method 2: Nanosilica Resin Slurry Preparation

A precursor solution may be prepared by combining 300.0 g Nalco™ 2327 colloidal silica (Nalco Chemical Company, Naperville, Ill.), 345.0 g 1-methoxy-2-propanol (Sigma-Aldrich, Inc. St. Louis, Mo.), 7.44 g A1230 proprietary nonionic silane dispersing agent (Union Carbide Corp., Danbury, Conn.), 14.78 g A174 gamma-methacryloxypropyl-trimethoxysilane (Union Carbide Corp., Danbury, Conn.). A1230 and A174 are first added to the 1-methoxy-2-propanol, this solution was then added drop wise to the Nalco 2327 colloidal silica. The precursor solution was placed in a glass container, sealed, placed in an oven at 80° C. for about 20 hours, removed from the oven and allowed to cool to room temperature.

The nanosilica resin slurry was prepared by combining 606.1 g precursor solution, 45.0 g SR339 2-phenoxyethyl acrylate and 30.0 g SR 9003 propoxylated neopentyl glycol diacrylate into a 1000 mL flask. The flask was connected to a Buchi™ RE121 rotary evaporator (from Buchi Labrotechnik AG, Switzerland) equipped with a Buchi™ 461 water bath having a water temperature between 50-60° C. and rotated at 120 revolutions per minute (rpm.) Using an aspirator, a vacuum of about 27 mm Hg was applied to the flask, the volatile components of the mixture began to evaporate, and were removed from the solution via a collection flask. After 15 minutes, the set point of the water bath was raised, such that a final bath temperature of about 90° C. was obtained. After water bath set point increase, vacuum of about 28 mm Hg was continued for about 2 hours. The composition was removed from the rotary evaporator and allowed to cool to room temperature. To 191.7 g of the above nanosilica composition was added 0.75 g Irgacure™ 819 and the nanosilica resin slurry was mixed for 30 minutes.

Method 3: Alumina Abrasive-Nanosilica Resin Slurry Preparation

Alumina abrasive-nanosilica resin slurries were prepared by mixing together appropriate amounts of alumina abrasive slurry, as described by Method 1, and nanosilica resin slurry, as described by method 2, for a period of about 15 minutes. A high shear mixing blade was used at low rpm. The following mixtures were prepared:

Mixture 1: 30.0 g nanosilica resin slurry and 60.0 g alumina abrasive slurry.

Mixture 2: 45.0 g nanosilica resin slurry and 45.0 g alumina abrasive slurry.

Mixture 3: 60.0 g nanosilica resin slurry and 30.0 g alumina abrasive slurry.

Mixture 4: 92.3 g nanosilica resin slurry and 10.8 g alumina abrasive slurry.

Method 4: Preparation of a Fixed Abrasive Article

A polypropylene production tool, approximately 50 cm by 50 cm (20 inches by 20 inches), was provided that comprised a series of cavities arranged in a predetermined array with the specified dimensions of a three-sided pyramids having a height of 63 μm and each side, although not being identical, having a width of about 125 μm, and corner angles of 55.5 degrees, 59 degrees and 55.5 degrees. The production tool was essentially the inverse of the desired shape, dimensions and arrangement of the abrasive composites. The production tool was secured to a metal carrier plate using a masking type pressure sensitive adhesive tape. The abrasive slurry was coated into the cavities of the production tool using a rubber squeegee such that the abrasive slurry completely filled the cavities. Next, 0.127 millimeter (5 mil) thick primed polyester (PET) backing was brought into contact with the abrasive slurry contained in the cavities of the production tool. The backing, abrasive slurry and production tool secured to the metal carrier plate, were passed through a bench top laboratory laminator from Chem Instruments (Model #001998). The article was continuously fed between two rubber rollers at a pressure of about 210-420 Pa (30-60 psi) and a speed of about 1 cm/sec.

Pressure adjustments were made depending on the general quality of the coating. A quartz plate, about 6.3 mm (¼ inch) thick was then placed on top of the backing covering the entire backing. The article was cured by passing the metal carrier plate, tool, abrasive slurry, backing and quartz plate under two ultraviolet light lamps ("V" bulb, available from Fusion Systems Inc.) that operated at about 157.5 Watts/cm (400 Watts/inch). The radiation passed through the quartz plate and PET backing. The speed was about 4.4 meters/minute (15 feet/minute) and the sample was passed under the lamps twice at the identical process conditions. The abrasive article was removed from the production tooling by gently pulling on the PET backing.

Using Method 4, the following four examples and two comparative examples of abrasive articles were prepared:

Example 1 prepared from Mixture 1

Example 2 prepared from Mixture 2

Example 3 prepared from Mixture 3

Example 4 prepared from Mixture 4

Comparative Example 1 prepared from the alumina abrasive slurry of Method 1.

Comparative Example 2 prepared from the nanosilica resin slurry of Method 2.

The particle sizes and volume compositional ratios for the Examples and Comparative Examples are summarized in Table 1.

TABLE 1

| Fixed Abrasive Article | Particle Size and Volume Compositional Ratios: Abrasive Particle Volume Mean Diameter (nm) | Filler Particle Volume Mean Diameter (nm) | Matrix/ Abrasive Volume Ratio | Binder/ Abrasive Volume Ratio | Abrasive/ Filler Volume Ratio |
|---|---|---|---|---|---|
| Example 1 | 300 | 20 | 2.69 | 2.26 | 2.32 |
| Example 2 | 300 | 20 | 3.96 | 3.10 | 1.16 |
| Example 3 | 300 | 20 | 6.49 | 4.76 | 0.58 |
| Example 4 | 300 | 20 | 23.08 | 15.70 | 0.14 |
| Comparative Example 1 | 300 | None | 1.43 | 1.43 | — |
| Comparative Example 2 | None | 20 | — | — | 0 |

The abrasive articles were laminated by hand to the rigid component of a subpad using 3M 442 DL pressure sensitive adhesive (available from the 3M Company, St. Paul, Minn.). The production manufactured subpads comprised a rigid component of polycarbonate, 8010MC Lexan Polycarbonate (PC) sheeting from GE Polymershapes (Mount Vernon, Ind.) laminated to a resilient component, a VOLTEC VOLARA Type EO foam 12 pounds per cubic foot from Voltek (a division of Sekisui America Corp., Lawrence, Mass.) with a 3M 9671 pressure sensitive adhesive (available from the 3M Company, St. Paul, Minn.). The abrasive article, attached to the subpad, was then die cut into a 30 cm (12 inch) diameter circular pad suitable for use in CMP polishing experiments.

Method 5: Wafer Polishing

Copper coated blanket wafers were made from a single crystal silicon base unit having a diameter of 100 mm and a thickness of about 0.5 mm; purchased from either WaferNet or Silicon Valley Microelectronics, both of San Jose, Calif. Before deposition of the metal layer, a silicon dioxide layer, TEOS, approximately 5,000 μm thick was deposited on the silicon wafer. A titanium adhesion/barrier layer was deposited on the silicon dioxide layer prior to metal deposition. The thickness of Ti was typically 200 μm but may range between 100 and 300 μm. A uniform layer of Cu was then deposited over the silicon base using physical vapor deposition (PVD). The thickness of the metal layer was typically between 11,000 and 12,000 μm. Four inch diameter (100 mm) Cu discs were obtained from Goodfellow Corp., Berwin, Pa.

Cu CMP Solution CPS-11 without the biocide was obtained from the 3M Company. An aqueous hydrogen peroxide solution (30% by weight hydrogen peroxide) was added to the CPS-11 prior to polishing. The CPS-11/30% $H_2O_2$ weight ratio was 945/55. This solution was used in all polishing experiments.

A Strausbaugh Model No. 6Y-1 polishing apparatus equipped with a carrier capable of holding 100 mm (3.94 inch) diameter wafers or discs was used for wafer polishing. Polishing was conducted at a platen speed of 40 rpm, a carrier speed of 40 rpm, a down force of 20.7 kPa (3.0 psi) and a polishing solution flow rate onto the pad of 40 mL/min. The polishing apparatus was obtained from R. H. Howard Strausbaugh, Inc., Long Beach, Calif. The polishing sequence depicted in Table 2 was employed.

TABLE 2

| Substrate | Polishing Sequence: Polishing Time (min) | Cumulative Polishing Time (min) |
|---|---|---|
| Blanket Cu Wafer 1 | 1 | 1 |
| Cu Disc | 5 | 6 |
| Blanket Cu Wafer 2 | 1 | 7 |
| Cu Disc | 5 | 12 |
| Cu Disc | 5 | 17 |
| Blanket Cu Wafer 3 | 1 | 18 |
| Cu Disc | 5 | 23 |
| Cu Disc | 5 | 28 |
| Cu Disc | 5 | 34 |
| Cu Disc | 5 | 38 |
| Blanket Cu Wafer 4 | 1 | 39 |
| Cu Disc | 5 | 44 |
| Cu Disc | 5 | 49 |
| Cu Disc | 5 | 54 |
| Cu Disc | 5 | 59 |
| Blanket Cu Wafer 5 | 1 | 60 |
| Cu Disc | 5 | 65 |
| Cu Disc | 5 | 70 |
| Cu Disc | 5 | 75 |
| Cu Disc | 5 | 80 |
| Blanket Cu Wafer 6 | 1 | 81 |

Removal rate was calculated by determining the change in thickness of the layer being polished from the initial (i.e., before polishing) thickness and the final (i.e., after polishing) thickness. Thickness measurements are made using a Tencor OmniMap NC110 Non-Contacting Metals Monitoring System from Tencor Instruments, Prometrix Division, Santa Clara, Calif. Five points were measured per wafer; one in the center of the wafer and four spaced at 90 degree intervals near the outer diameter of the wafer approximately 8.9 cm (3.5 inches) from the center of the wafer. The final removal rate value for a given fixed abrasive articles may be the average value of the last five blanket wafers polished, as defined in Table 2.

After polishing, the apparent % bearing area of the pad (% BA) was measured via optical microscopy, by comparing the average size of the triangular contact surface of abrasive article to the known size of the triangular base. Four sites per pad, approximately 90° apart and about 75 millimeters (3 inches) out from the pad center were examined. Ten triangles, comprising part of the abrasive article's surface, were measured per site and an average taken, then the average of the four sites was taken as a final value of the apparent % bearing area.

The volume of fixed abrasive article removed during the polishing test scales as the apparent % bearing area to the ⅔ power.

Based on the apparent % bearing area, a value for the relative volume of wear may be calculated as follows:

$$\text{Relative Volume of Wear}=[(\%\,BA)^{3/2}]/[(\%\,BA\ \text{Comparative Example 1})^{3/2}]$$

The relative volume of wear for all abrasive articles was calculated with the % BA of Comparative Example 1 in the denominator of the above equation. The relative volume of wear for each fixed abrasive article along with the deviation from that expected for a linear interpolation between that of Comparative Examples 1 and 2, in percent, is shown in Table 3. The Cu removal rate and deviation from that expected for a linear interpolation between that of Comparative Examples 1 and 2, in percent, is shown in Table 4. The volume fraction of alumina, as shown in Table 4, is the ratio of the volume of alumina to the volume of alumina plus inorganic filler.

TABLE 3

Relative Volume Wear and Deviation from Linearity

| Fixed Abrasive Article | Volume Fraction of Alumina | Relative Volume Wear | Deviation from Linearity (%) |
|---|---|---|---|
| Example 1 | 0.70 | 0.57 | −28 |
| Example 2 | 0.54 | 0.50 | −27 |
| Example 3 | 0.37 | 0.28 | −51 |
| Example 4 | 0.12 | 0.16 | −60 |
| Comparative Example 1 | 1.00 | 1.00 | NA |
| Comparative Example 2 | 0.00 | 0.32 | NA |

TABLE 4

Relative Cu Removal Rate and Deviation from Linearity

| Fixed Abrasive Article | Volume Fraction of Alumina | Cu Removal Rate (Å/min) | Deviation from Linearity (%) |
|---|---|---|---|
| Example 1 | 0.70 | 5,484 | 0 |
| Example 2 | 0.54 | 5,674 | 9 |
| Example 3 | 0.37 | 5,593 | 16 |
| Example 4 | 0.12 | 4,596 | 6 |
| Comparative Example 1 | 1.00 | 6,116 | NA |
| Comparative Example 2 | 0.00 | 4,085 | NA |

It should be apparent to those skilled in the art from the above description that various modifications can be made without departing from the scope and principles of this disclosure, and it should be understood that this disclosure is not to be unduly limited to the illustrative embodiments set forth hereinabove. All publications and patents are herein incorporated by reference to the same extent as if each individual publication or patent was specifically and individually indicated to be incorporated by reference. Various embodiments of the disclosure have been described. These and other embodiments are within the scope of the following claims.

I claim:

1. A fixed abrasive article comprising:

a plurality of three-dimensional abrasive composites fixed to the abrasive article, wherein the abrasive composites comprise a plurality of abrasive particles having a volume mean diameter less than 500 nanometers (nm) in a matrix material, the matrix material comprising a polymeric binder and a plurality of inorganic filler particles having a volume mean diameter no greater than 200 nanometers.

2. The fixed abrasive article of claim 1, wherein the inorganic filler particles have a volume mean diameter no greater than 25 nm.

3. The fixed abrasive article of claim 1, wherein the inorganic filler particles have a surface treatment selected from silanes, titanates, zirconates, organophosphates, organosulfonates, and combinations thereof.

4. The fixed abrasive article of claim 1, wherein the abrasive particles comprise alumina, ceria, silica, zirconia, boron carbide, silicon nitride, cubic boron nitride, diamonds, or a combination thereof.

5. The fixed abrasive article of claim 1, wherein the inorganic filler particles comprise silica, alumina, titania, zirconia, glass, or a combination thereof.

6. The fixed abrasive article of claim 1, further comprising one or more of a backing, an adhesive, and a subpad.

7. A method of making the fixed abrasive article of claim 1, comprising:

dispersing the inorganic filler particles having a volume mean diameter no greater than 200 nanometers in a polymeric binder to form the matrix material;

dispersing the abrasive particles having a volume mean diameter less than 500 nm in the matrix material; and forming the plurality of three-dimensional abrasive composites comprising the abrasive particles dispersed in the matrix material.

8. A method of using the fixed abrasive article of claim 1, comprising:

providing a workpiece;

contacting the workpiece with the fixed abrasive article according to claim 1; and relatively moving the workpiece and the fixed abrasive article, optionally in the presence of a liquid medium.

9. A fixed abrasive article comprising:

a plurality of three-dimensional abrasive composites fixed to the abrasive article, wherein the abrasive composites comprise a plurality of non-ceria abrasive particles in a matrix material, wherein the matrix material further comprises a polymeric binder and a plurality of inorganic filler particles having a volume mean diameter no greater than 1.000 nm, and wherein a ratio of the amount of matrix material to the amount of non-ceria abrasive particles on a volumetric basis is at least 2:1.

10. The fixed abrasive article of claim 9, wherein a ratio of the amount of non-ceria abrasive particles to the amount of inorganic filler particles on a volumetric basis is at most 3:1, and wherein a ratio of the amount of polymeric binder to the amount of non-ceria abrasive particles on a volumetric basis is at least 2:1.

11. The fixed abrasive article of claim 9, wherein the non-ceria abrasive particles have a volume mean diameter of at most 40 micrometers.

12. The fixed abrasive article of claim 9, wherein the inorganic filler particles have a volume mean diameter no greater than 200 mm.

13. The fixed abrasive article of claim 9, wherein the inorganic filler particles have a surface treatment selected from silanes, titanates, zirconates, organophosphates, organosulfonates, and combinations thereof.

14. The fixed abrasive article of claim 9, wherein the non-ceria abrasive particles comprise alumina, silica, zirconia, boron carbide, silicon nitride, cubic boron nitride, diamonds, or a combination thereof.

15. The fixed abrasive article of claim 9, wherein the inorganic filler particles comprise silica, alumina, titania, zirconia, glass, or a combination thereof.

16. The fixed abrasive article of claim 9, further comprising one or more of a backing, an adhesive, and a subpad.

17. A method of making the fixed abrasive article of claim 9, comprising:

dispersing the inorganic filler particles having a volume mean diameter no greater than 1,000 nm in the polymeric binder to form the matrix material;

dispersing the non-ceria abrasive particles in the matrix material, wherein the ratio of the amount of matrix material to the amount of non-ceria abrasive particles on a volumetric basis is at least 2:1; and forming the plurality of three-dimensional abrasive composites comprising the non-ceria abrasive particles dispersed in the matrix material.

18. A method of using the fixed abrasive article of claim 9, comprising:

providing a workpiece;

contacting the workpiece with the fixed abrasive article according to claim 9; and relatively moving the workpiece and the fixed abrasive article, optionally in the presence of a liquid medium.

19. A fixed abrasive article comprising:

a plurality of three-dimensional abrasive composites fixed to the abrasive article, wherein the abrasive composites comprise a plurality of non-ceria abrasive particles in a matrix material, wherein the matrix material further comprises a polymeric binder and a plurality of inorganic filler particles having a volume mean diameter no greater than 1,000 nm, and wherein a ratio of the amount of non-ceria abrasive particles to the amount of inorganic filler particles on a volumetric basis is no greater than 3:1.

20. The fixed abrasive article of claim 19, wherein a ratio of the amount of matrix material to the amount of non-ceria abrasive particles on a volumetric basis is at least 2:1, and wherein a ratio of the amount of polymeric binder to the amount of non-ceria abrasive particles on a volumetric basis is at least 2:1.

21. The fixed abrasive article of claim 19, wherein the non-ceria abrasive particles have a volume mean diameter of no more than 1,000 nm.

22. The fixed abrasive article of claim 19, wherein the inorganic filler particles have a volume mean diameter no greater than 200 nm.

23. The fixed abrasive article of claim 19, wherein the non-ceria abrasive particles comprise alumina, silica, zirconia, boron carbide, silicon nitride, cubic boron nitride, diamonds, or a combination thereof.

24. The fixed abrasive article of claim 19, wherein the inorganic filler particles comprise silica, alumina, titania, zirconia, glass, or a combination thereof.

25. The fixed abrasive article of claim 19, further comprising one or more of a backing, an adhesive, and a subpad.

26. A method of making the fixed abrasive article of claim 19, comprising:

dispersing the inorganic filler particles having a volume mean diameter no greater than 1000 nanometers in the polymeric binder to form the matrix material;

dispersing the non-ceria abrasive particles in the matrix material, wherein the ratio of the amount of non-ceria abrasive particles to the amount of inorganic filler on a volumetric basis is no greater than 3:1; and forming the plurality of three-dimensional abrasive composites comprising the non-ceria abrasive particles dispersed in the matrix material.

27. A method of using the fixed abrasive article of claim 19, comprising:

providing a workpiece contacting the workpiece with a fixed abrasive article according to claim 19; and relatively moving the workpiece and the fixed abrasive article, optionally in the presence of a liquid medium.

* * * * *

UNITED STATES PATENT AND TRADEMARK OFFICE

CERTIFICATE OF CORRECTION

PATENT NO. : 7,497,885 B2
APPLICATION NO. : 11/671037
DATED : March 3, 2009
INVENTOR(S) : Jeffrey S. Kollodge It is certified that error appears in the above-identified patent and that said Letters Patent is hereby corrected as shown below:

Column 1
Line 20, delete "wafers," and insert --wafers.--
Line 64, delete "employed" and insert --employed.--

Column 5
Line 45, delete "1,000 μm" and insert --1,000 nm--

Column 6
Line 49, delete "article," and insert --article.--
Lines 64-65, delete "nanoparticlulate" and insert --nanoparticulate--
Line 67, delete "nanoparticlulate" and insert --nanoparticulate--

Column 7
Line 44, delete "compositon" and insert --composition--
Line 61, delete "5,000 nanometers, m" and insert --5,000 nanometers, nm--
Line 67, delete "500 μm" and insert --500 nm--

Column 8
Line 36, delete "nanoparticlulate" and insert --nanoparticulate--
Line 39, delete "Nanoparticlulate" and insert --Nanoparticulate--
Line 57, delete "prefered" and insert --preferred--

Column 9
Line 33, delete "nanoparticlulate" and insert --nanoparticulate--
Line 45, delete "gamm-methacryloxypropyltrimethoxysilane" and insert --gamma-methacryloxypropyltrimethoxysilane--
Lines 46-47, after "gamma--glycidoxypropyltrimethoxysilane" insert --,--

Signed and Sealed this
Twelfth Day of April, 2011

David J. Kappos

David J. Kappos
*Director of the United States Patent and Trademark Office*

Column 10
Line 31, delete “polymric” and insert --polymeric--

Column 11
Line 44, delete “reacive” and insert --reactive--

Column 13
Line 16, delete “reference/” and insert --reference.--

Column 15
Line 54, delete “Åmin.” and insert --Å/min.--

Column 22
Line 26, delete “1.000” and insert --1,000--
Line 41, delete “200 mm” and insert --200 nm--